US009320953B2

(12) United States Patent
Belete et al.

(10) Patent No.: US 9,320,953 B2
(45) Date of Patent: Apr. 26, 2016

(54) STACK-AND-AVOID GAME KIT

(76) Inventors: Tewabtch Belete, San Francisco, CA (US); Marechet Belete, San Francisco, CA (US)

( * ) Notice: Subject to any disclaimer, the term of this patent is extended or adjusted under 35 U.S.C. 154(b) by 956 days.

(21) Appl. No.: 13/472,335

(22) Filed: May 15, 2012

(65) Prior Publication Data

US 2012/0283051 A1 Nov. 8, 2012

Related U.S. Application Data

(60) Continuation-in-part of application No. 13/103,054, filed on May 7, 2011, now Pat. No. 8,201,829, which is a division of application No. 12/383,029, filed on Mar. 19, 2009, now abandoned.

(51) Int. Cl.

| | |
|---|---|
| ***A63B 67/06*** | (2006.01) |
| *A63B 43/00* | (2006.01) |
| *A63B 71/00* | (2006.01) |

(52) U.S. Cl.

CPC ..... *A63B 67/066* (2013.01); *A63B 43/00* (2013.01); *A63B 67/06* (2013.01); *A63B 71/0036* (2013.01); *A63B 2067/061* (2013.01)

(58) Field of Classification Search

CPC ..... A63B 67/06; A63B 67/066; A63B 63/00; A63B 2208/12; A63B 2210/50; A63B 2067/061

USPC ..... 273/393, 398–402, 236; 473/476–478

See application file for complete search history.

(56) References Cited

U.S. PATENT DOCUMENTS

| | | | | |
|---|---|---|---|---|
| 2,430,681 | A | 11/1947 | Johnson | |
| 2,520,392 | A | 8/1950 | Flenghi | |
| 2,849,238 | A * | 8/1958 | Eldredge | 473/180 |
| 3,024,024 | A | 3/1962 | Chalcroft | |
| 3,495,830 | A * | 2/1970 | Farrelli | 273/400 |
| 3,761,087 | A | 9/1973 | Meyer | |
| 3,797,833 | A * | 3/1974 | Rokusek | 473/180 |
| 4,017,076 | A | 4/1977 | Bai | |
| 4,325,556 | A | 4/1982 | DeCanto et al. | |
| 4,330,130 | A | 5/1982 | Carr | |
| 4,378,944 | A | 4/1983 | Johnston | |
| 4,453,713 | A | 6/1984 | Guyer | |
| 4,718,677 | A | 1/1988 | Barnes | |
| 4,744,567 | A | 5/1988 | Kochmanski et al. | |
| 4,986,548 | A | 1/1991 | Conner | |
| 4,989,880 | A * | 2/1991 | Gettemeier et al. | 273/336 |
| 5,082,291 | A | 1/1992 | Appel et al. | |
| 5,123,656 | A * | 6/1992 | Green | 273/400 |
| 5,139,273 | A | 8/1992 | Rudell et al. | |
| 5,290,040 | A * | 3/1994 | Boroski | 273/348.4 |
| 5,348,306 | A | 9/1994 | Strishak et al. | |
| 5,575,483 | A * | 11/1996 | Dineen et al. | 273/317.2 |
| 5,624,121 | A | 4/1997 | Stern | |
| 5,707,062 | A | 1/1998 | Perillo et al. | |
| 5,873,573 | A | 2/1999 | Beatty, Jr. | |
| 6,352,262 | B1 | 3/2002 | Looney | |
| 6,843,478 | B1 | 1/2005 | Hopelman | |
| 6,899,336 | B2 | 5/2005 | Michelet et al. | |
| 7,360,767 | B2 | 4/2008 | Merccica | |
| 7,611,427 | B1 | 11/2009 | Cline | |
| 2003/0025267 | A1 | 2/2003 | Stubberfield | |
| 2006/0022409 | A1 * | 2/2006 | Zimmermann | 273/400 |
| 2007/0187891 | A1 | 8/2007 | Hoeting | |

* cited by examiner

*Primary Examiner* — Mark Graham

(74) *Attorney, Agent, or Firm* — Michael J. O'Connell

(57) ABSTRACT

A stack-and-avoid game kit includes a container and game pieces held in the container. The game pieces include stackable figures and a soft projectile. Each stackable figure includes a base that forms a plug and an upper part that forms a cup. Each stackable figure is configured such that a plug of one is stackable in the cup of another.

8 Claims, 3 Drawing Sheets

STACK-AND-AVOID GAME KIT

CROSS-REFERENCE TO RELATED APPLICATIONS

This application is a continuation-in-part application of co-pending U.S. patent application Ser. No. 13/103,054 filed on May 7, 2011, which is a divisional application of U.S. patent application Ser. No. 12/383,029 filed on Mar. 19, 2009, the contents of which are hereby incorporated by reference in their entirety.

FIELD OF THE INVENTION

This invention generally relates to games involving throwing a projectile, particularly to target games involving throwing a ball and tagging opposing team members.

BACKGROUND OF THE INVENTION

Target game, very old in introduction, has been changing and evolving over time due to creative minds. The target game, U.S. Pat. No. 4,017,076, makes use of a plastic ball that is partially covered with velcro strip to be tossed from one player to the other to be caught by the fabric target glove or dish shaped mitt. While the throw and catch game, U.S. Pat. No. 4,718,677, contains a projectile covered with a velcro material, the projectile is caught by the knees or elbows receivers. The mentioned inventions objective is for one player to throw a projectile covered with bonding material for another player to receive the projectile by a glove or knee and elbow receivers partially covered with bonding material.

Of particular interests to our invention are body ball tag game and projectile and target game apparatus. Body ball tag game, U.S. Pat. No. 4,986,548, involves a projectile with velcro pad to be thrown at a person wearing a front and back uniform with velcro hook target. Projectile and target game apparatus, U.S. Pat. No. 5,082,291, involves at least one projectile and one cap. All of the inventions mentioned above are developed with the intention for all ages. These games develop some sort of coordination between eye and hand, arms, legs and/or upper body.

The reason the two inventions, U.S. Pat. No. 4,986,548 and U.S. Pat. No. 5,082,291, particularly grasp our attention is because the games can be played with opposing teams, where one throws a projectile with the intention of tagging the opponent who tries to avoid being hit. Even if the above mentioned inventions grasp our attention, there is no mention of a tag game with stackable figure. In addition there is no mention of ways of bringing back tagged team mates, while playing these games. Our invention, stack and avoid game, is a game that involves stacking up stackable figures while trying to avoiding being tagged by a projectile. When four or more people are playing stack and avoid game, if at least one team member accomplishes stacking up all the plugs while avoiding being tagged, all the team members that were tagged out can get back in the game. As you read further, it will become obvious that this invention differs' from target games known to the art.

SUMMARY

A stack and avoid game played with a projectile and stackable figures; where one team's members try to tag all members of the other team, before they finish stacking up the stackable figures.

According to an embodiment, a stack-and-avoid game kit of the present invention includes a container and game pieces held in the container. The game pieces include stackable figures and a soft projectile.

DRAWINGS

Figures

REFERENCE NUMERALS

Figure 1:
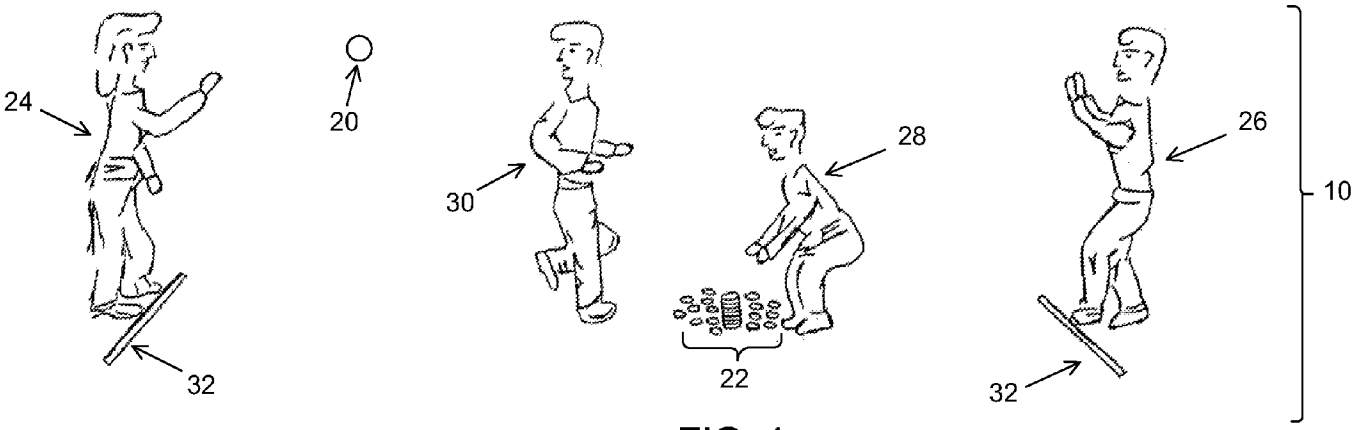
FIG. 1 is a side representation of limited space version of the game being played by four players and with more than six stackable plugs.
Figure 2:
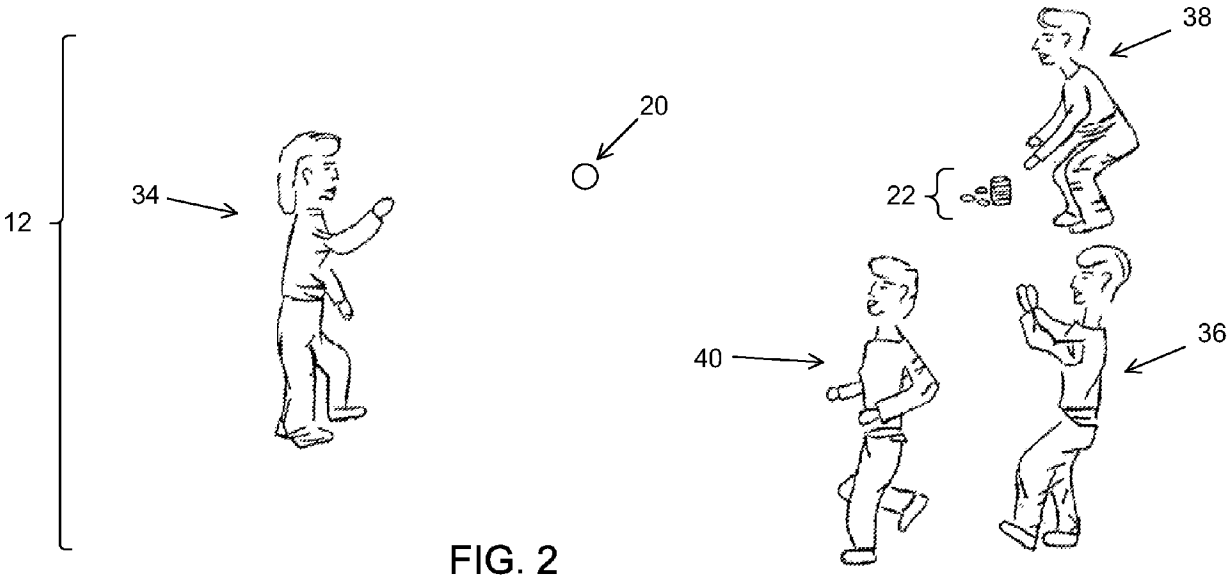
FIG. 2 is a side representation of unlimited space version of the game being played by four players with six stackable plugs; unlimited being a much bigger or wider space than the imaginary rectangular space that would be set while playing the limited space version of the game.

10 limited space of FIG. 1
12 unlimited space of FIG. 2
20 ball
22 plug
24 one of the taggers on FIG. 1
26 the other tagger on FIG. 1
28 one of the tagged team member on FIG. 1
30 the other tagged team member on FIG. 1
32 Boundary mark
34 one of the taggers on FIG. 2
36 the other tagger on FIG. 2
38 one of the tagged team member on FIG. 2
40 the other tagged team member on FIG. 2
42 the base of the plug
44 top part of the plug
46 the downward curving part of the plug
48 length of the boundary mark maker
50 width of the boundary mark maker
100 a stack-and-avoid game kit
102 a container
104 stack-and-avoid game pieces
108 stackable figures
110 a soft projectile
112 a boundary marker
114 a lid for the container 102
116 a portion of a playing surface
117 a cup of a stackable figure 108
118 a stack of six the stackable figures 108
119 a plug of a stackable figure 108
120 a stack of two the stackable figures 108
122 a flexible portion of the boundary marker 112
124 end pieces of the boundary marker 112

DETAILED DESCRIPTION

To play the game the preferred gears needed are shown on FIG. 3A to FIG. 3C and FIG. 4; suggested at least six stackable plugs 22 and a foam ball 20. If there are less than suggested four people, three people, each person could play as a single team. Those involved in the game can chose who will be the first to be tagged. If the tagged person is able to finish stacking up the figures while avoiding being tagged, it will be considered a point. But if the person is tagged out, the person will switch roles with the second person chosen to be tagged. And at the end of the game, when all three people have been able to play and the game is finished, the person with the most points will be considered the winner. As suggested if there are four or more people playing the game, the tagged team's members will try to avoid being tagged by the foam ball 20 thrown at them by the opposing team members and try to stack up all the plugs 22 before everyone in their team is tagged out. When the opposing team's members tag all members of the tagged team before they stack up all the plugs 22, the teams change roles; the tagged team will be the tagger team and vise versa.

The foam ball 20 is made up of a foam material and its diameter is approximately two point five inches (2.5".) The factors required are for the ball 20 to be thrown to a reasonable distance and soft enough to avoid injuries. There are other materials and shapes that might be used to make the projectile 20 besides the suggested foam ball. The plug 22 is made from plastic. As shown on FIG. 3A, FIG. 3B, and FIG. 3C, the plug 22 is made to look like a small cup with a downward curve starting at the top. The plug's base 42 is approximately 0.45 inch in radius, the top part 44 radius is approximately 0.50 inch and size of the downward curved part 46 is about 0.17 inch all around the top part 44. The difference in the diameter between the base 42 and the top part 44 of the plug 22 makes it easy to stack up one plug on top of any other plug with the same dimensions. At the same time, the structure and dimensions of the plug 22 avoids one plug from being stuck strongly into another plug. Of course, varieties of designs are feasible to substitute the plug 22 mentioned as preferred embodiments. The requirements for feasible substitute designs of the stackable plug are for the figure to be stackable and have reasonably acceptable size.

The main concept of the game is for the tagged team members to stack up all the plugs 22 before all their team mates get tagged out; doing that will give their tagged out team members another chance at getting back in the game. When the opposing team members tag all the tagged team members before they finish stacking up the plugs, the teams will change roles. There are two possible ways of playing this game.

Figure 5A:
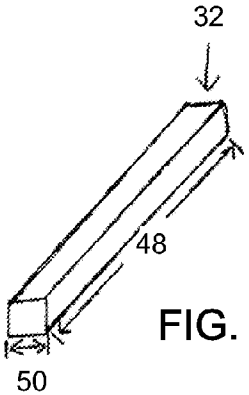
FIGS. 5A and 5B are two different sides view of a rectangular cube foam figure that could be used to make boundary marks.
Figure 5B:
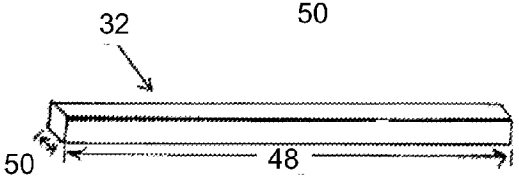
Figure 4:
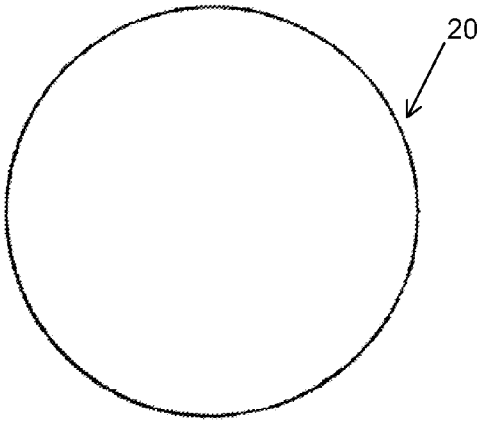
FIG. 4 is a side view of a foam ball that is in agreement with the concept of the invention.
Figure 3A:
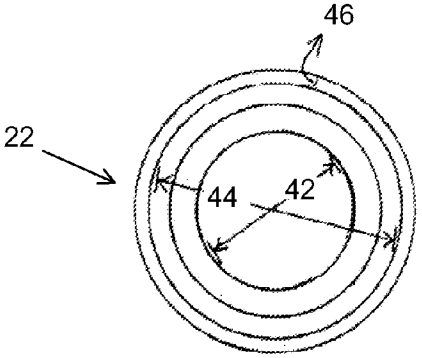
FIGS. 3A to 3C is a bird's eye, an internal, and a side view of a stackable plug constructed in accordance with the concepts of the invention and used in the game illustrated both in FIG. 1 and FIG. 2.
Figure 3B:
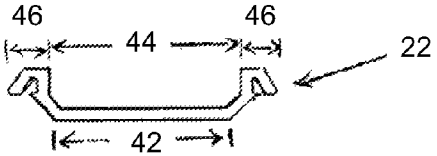
Figure 3C:
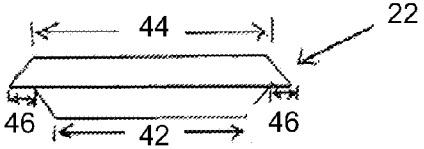

One way of playing the game is in a limited space 10 with a foam ball 20 and plugs 22. As seen on FIG. 1, when playing the game in a limited space it is recommended that there be at least four people 24, 26, 28 and 30 and at least six plugs 22. The number of the plugs 22 can be decreased to make the game easier or increased to make the game a bit difficult. Twelve is the suggested number of plugs when playing the game with total number of four people; two people on each team. It is also recommended to increase the plugs by six when a person is added on each team. Even if the game can be played by more than four people we will use the minimum suggested number to explain the game, as seen on FIG. 1. The taggers 24 and 26 will stand at about approximately twenty feet apart and at approximately ten feet in the middle on a designated spot the plugs 22 will be placed. FIG. 5A and FIG. 5B illustrate a rectangular foam figure that could be used as a boundary mark 32 to make sure that the taggers will not violate the twenty feet distance excessively to get close to the tagged team members. The rectangular boundary mark 32 has an approximate length of 14 inches, width of 1 inch and height of 1 inch. There are other materials or means that are feasible to substitute the rectangular cube for making the boundary mark. The only requirement for a substitute is having something that is visible enough to serve as a boundary mark. At about twenty feet apart, the taggers 24 and 26 collaborate by passing the ball 20 back and forth and throwing the ball 20 at the tagged team members 28 and 30 trying to tag them out. During the game, the tagged team members 28 and 30 who are in the middle are required not to wander more than approximately four feet apart to the right and left of the center; the imaginary line that starts from one side of the boundary mark 32, passes through the designated spot of the stackable plugs 22 and ends at the other side of the boundary mark 32. As long as they don't wander off too far on the sides and go past the boundary mark 32, the tagged team members 28 and 30 can move back and forth freely while trying to avoid being tagged when stacking up the plugs 22. There is an option for the people playing the game to decide if they want to have or create penalties for wandering excessively outside boundaries. For example, a tagged player who steps outside the boundaries excessively three times could be considered as tagged out or six stacked up plugs can be taken apart. On the other hand if the tagger's violate the boundary mark excessively three times they could give one lifeline for one tagged out opposing team member. However, it is up to the people playing the game to decide to have a penalty or not. If one of the tagged team members 30 was tagged and the other team member 28 was left to be tagged and s/he managed to finish stacking up the plugs 22, s/he will be able to bring her/his tagged team mate 30 back in the game. If the taggers 24 and 26 tagged the opposing team members 28 and 30 before they finished stacking up all the plugs 22, they will switch rolls with the tagged team. If more than four people are playing the game the tagger's team members are all allowed to participate in tagging anyway they want as long as all of them are behind the boundary mark 32. For the tagged team members who will be in the middle, it is possible for all of them to get in at once; but it is suggested that two people get in and whenever one person gets tagged another person gets in. Doing this will make it less crowded, both for effectively moving back and forth in the area available and stacking up the plugs 22.

Another way of playing the game is in an unlimited space 12 with a foam ball 20 and plugs 22; unlimited space being a much bigger or wider space than the imaginary rectangular space that would be set while playing the limited space version of the game. As seen on FIG. 2, when playing the game in an unlimited space, it is recommended to use six plugs 22 and four is the suggested minimum number of people 34, 36, 38 and 40. Even if the recommended number of plugs 22 is six, there is an option of decreasing or increasing the number of plugs. There will be a designated spot chosen in this big area for the plugs 22. It is up to the people playing the game to decide how they want to select which team will be the tagger or the tagged first. The taggers 34 and 36, on FIG. 2, will be allowed to move around following the tagged team members 38 and 40 as long as the ball is not in their hand. Every time one of the taggers', 34 or 36, holds the ball 20 s/he has to stay in the same spot until s/he passes the ball 20 to her/his team mate or throws it at the opposing team members 38 or 40. The tagging team members 34 and 36 collaborate with each other by passing the ball 20 back and forth and throwing the ball 20 to tag the tagged team members 38 or 40. If the taggers 34 and 36 tag everyone out, they will switch rolls with the opposing team 38 and 40. The opposing team 38 and 40 on the other hand will move around freely trying to stack the plugs 22 before everyone is tagged. If there is one team member 38 or 40 left to be tagged and finishes stacking up all the plugs 22 while avoiding being tagged, s/he will be able to bring her/his tagged team mate back in the game. Since there is enough space to avoid over crowdedness, when more than four people are playing this way, it is recommended that everyone in both teams get in the game to tag or to be tagged. If there are less than four people, three people, each person could play as a single team. Those involved in the game can chose who will be the first to be tagged. If the tagged person finishes stacking up the plugs 22 while avoiding being tagged, it will be considered a point. But if the person is tagged out before finishing stacking up the plugs 22, the person will switch roles with the second person in line. At the end of the game, when all three people have been able to play and the game is finished, the person with the most points will be considered the winner.

To make the game a bit more challenging while trying to determine which team gets to be tagged first it is recommended that the plugs 22 be stacked up at the designated location. Once the plugs 22 are stacked up, the team chosen to go first by the players will get four chances to break the stacked up plugs 22 from about eight feet. The team members can attempt to break the stacked up plugs by tossing or rolling the ball 20. If the team who get's the first four chances fails to break the stacked up plugs 22, the other team will also get four chances to break the plugs 22. The teams will switch turns until one team breaks the stacked up plugs 22. The team who breaks the stacked up plugs 22 gets to decide if they want to be the tagged or the tagger. This way of starting off the game is suggested in both limited and unlimited ways of playing the game. At the same time, there are other methods that are feasible to substitute the way of picking roles for the teams at the beginning of the game.

Figure 6:
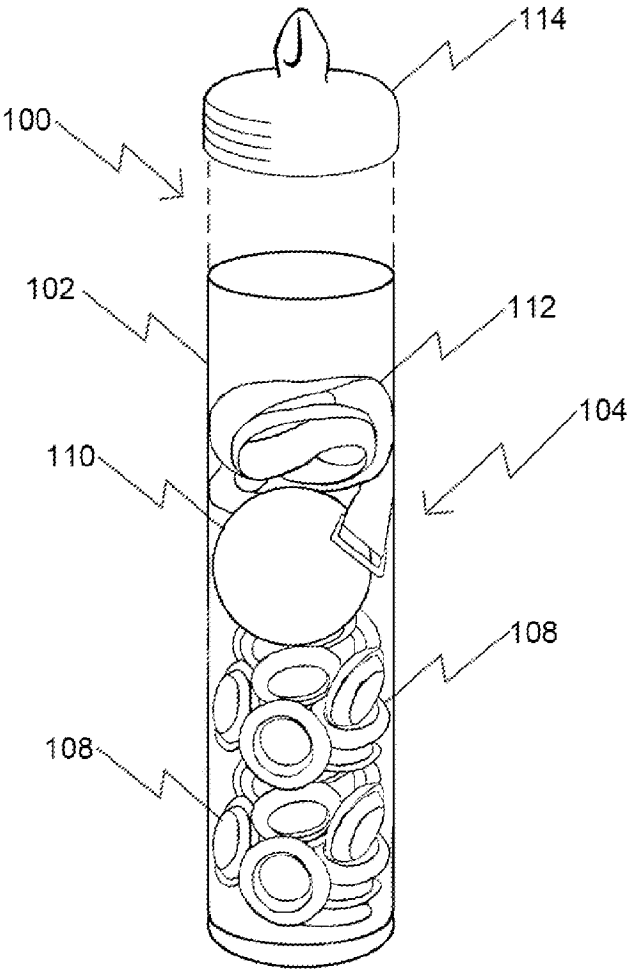
FIG. 6 illustrates an embodiment of a stack-and-avoid game kit of the present invention.

An embodiment of a stack-and-avoid game kit of the present invention is illustrated in FIG. 6. The stack-and-avoid game kit 100 includes a container 102 that holds game pieces 104. In an embodiment, the container 102 has a cylindrical shape and is made of a plastic material (e.g., clear plastic). In another embodiment, the container has another shape or is made of some other material. The game pieces 104 include stackable figures 108 and a soft projectile 110. According to an embodiment, the soft projectile 110 is a soft ball. For example, the soft ball may be a foam or rubber ball. According to another embodiment, the soft projectile may have another shape or form (e.g. a soft football). According to an embodiment, the stack-and-avoid game kit 100 includes a boundary marker 112. In another embodiment, the stack-and-avoid game kit includes two of the boundary markers 112. In an embodiment, the stack-and-avoid kit includes a lid 114 that covers an opening of the container 102.

It will be readily apparent to one skilled in the art that the container can take another form. For example, the game pieces 104 may be placed in a container (not shown) that comprises a cardboard piece, and plastic wrapping or a plastic shell with the game pieces 104 held between the cardboard piece and the plastic wrapping or shell.

Figure 7:
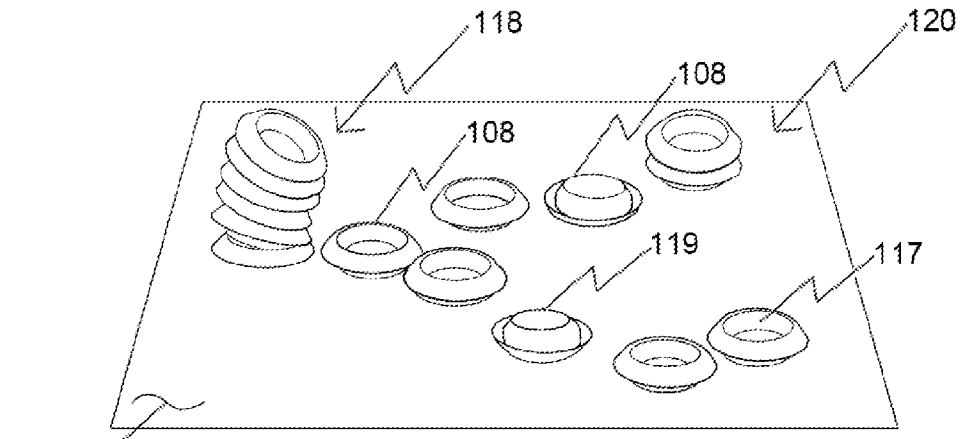
FIG. 7 illustrates stackable figures on a portion of a playing surface in accordance with an embodiment of the present invention.
Figure 8:
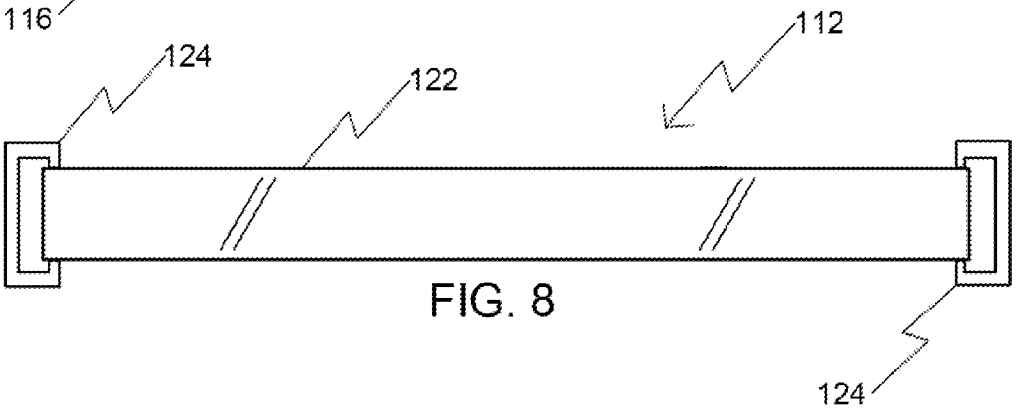
FIG. 8 illustrates an embodiment of a boundary marker of the present invention.

FIG. 7 illustrates the stackable figures 108 on a portion 116 of a playing surface in accordance with an embodiment of the present invention. Some of the stackable figures 108 are shown as separate from others of the stackable figures 108. Also shown are a stack 118 of six of the stackable figures 108 and a stack 120 of two of the stackable figures 108. In an embodiment, the stackable figures have a disk shape and a center cup 117 on one side and a plug 119 on the other side. In another embodiment, the stackable figures have some other shape (e.g., a triangular shape or a square shape) and also have a cup on one side, which may have a cross-section other than circular (e.g. a triangular or square cross-section), and a plug on the other side, which also may have a cross-section other than circular. In an embodiment, each stackable figure is configured such that any two stackable figures are stackable by placing the plug 119 of one into the cup 117 of the other. The stacks 118 and 120 show the stackable figures 108 with the plug 119 facing down and the cup 117 facing up. But the stackable figures 108 can be stacked with the cup 117 facing down and the plug 119 facing up.

An embodiment of the boundary marker 112 is illustrated in FIG. 7. The boundary marker 112 includes a flexible material 122 and end pieces 124 coupled to the flexible material 122. According to an embodiment, the flexible material 122 is made of a cloth-like material (e.g., nylon, polyester, cotton, or hemp). In another embodiment, the flexible material is some other flexible material (e.g., plastic or foam). According to an embodiment, the end pieces 124 are made of plastic. In another embodiment, the end pieces 124 are made of some other material (e.g., metal).

The distances and descriptions above are means of illustration not means of limitations. Although the materials and designs mentioned above are recommended, other modifications to materials and designs of the stackable figures, projectile, boundary maker, container, etc. are feasible without departing from the spirit and scope of the invention.

We claim:

1. A stack-and-avoid game kit comprising:
a container; and
game pieces held in the container, the game pieces comprising:
stackable figures, each stackable figure including a plug on a first side and a cup on a second side such that any two of the stackable figures are stackable by placing the plug of one into the cup of the other, each stackable figure having a stackable figure size; and
a soft projectile having a projectile size larger than the stackable figure size.

2. A stack-and-avoid game kit comprising:
a container; and
game pieces held in the container, the game pieces comprising:
stackable figures, each stackable figure including a base that forms a plug and an upper part that forms a cup such that any two of the stackable figures are stackable by placing the plug of one into the cup of the other, each stackable figure having a stackable figure size; and
a soft projectile having a projectile size larger than the stackable figure size.

3. The stack-and-avoid game kit of claim 2 wherein the container comprises a cylindrically shaped container.

4. The stack-and-avoid game kit of claim 2 further comprising a lid that closes an opening for the container.

5. The stack-and-avoid game kit of claim 2 wherein the game pieces further comprise a boundary marker.

6. The stack-and-avoid game kit of claim 2 wherein the soft projectile comprises a ball.

7. The stack-and-avoid game kit of claim 2 wherein each of the stackable figures comprises a disk shape.

8. A stack-and-avoid game kit comprising:
a container; and
game pieces held in the container, the game pieces comprising:

stackable figures, each stackable figure including a base that forms a plug and an upper part that forms a cup, any two stackable figures are interchangeably stackable by placing the plug of one into the cup of the other, each stackable figure having a stackable figure size; and a soft projectile having a projectile size larger than the stackable figure size.

* * * * *